US010788253B2

(12) United States Patent
Bird

(10) Patent No.: US 10,788,253 B2
(45) Date of Patent: Sep. 29, 2020

(54) ICEMAKER WITH A HINGED FEELER ARM

(71) Applicant: Haier US Appliance Solutions, Inc., Wilmington, DE (US)

(72) Inventor: Christopher Francis Bird, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 99 days.

(21) Appl. No.: 16/010,570

(22) Filed: Jun. 18, 2018

(65) Prior Publication Data

US 2019/0383542 A1 Dec. 19, 2019

(51) Int. Cl.
*F25C 5/187* (2018.01)
*F25D 29/00* (2006.01)

(52) U.S. Cl.
CPC ..... *F25C 5/187* (2013.01); *F25D 29/005* (2013.01); *F25D 29/006* (2013.01); *F25D 2500/06* (2013.01); *F25D 2700/06* (2013.01)

(58) Field of Classification Search
CPC ..... F25C 5/187
See application file for complete search history.

(56) References Cited

U.S. PATENT DOCUMENTS

| | | | | |
|---|---|---|---|---|
| 4,662,182 | A * | 5/1987 | Tsukiyama | F25C 5/187 200/61.21 |
| 4,719,762 | A | 1/1988 | Osabe | |
| 7,383,690 | B2 | 6/2008 | Maglinger et al. | |
| 9,151,530 | B2 * | 10/2015 | Tanaka | F25C 5/187 |
| 2009/0031736 | A1 | 2/2009 | Su et al. | |
| 2012/0186288 | A1 * | 7/2012 | Hapke | F25C 5/187 62/137 |
| 2015/0276295 | A1 * | 10/2015 | Barrena | F25C 1/04 62/135 |
| 2016/0076803 | A1 * | 3/2016 | Pawar | F25C 5/187 62/137 |
| 2019/0041112 | A1 * | 2/2019 | Chatelle | F25C 1/25 |

* cited by examiner

*Primary Examiner* — Filip Zec
(74) *Attorney, Agent, or Firm* — Dority & Manning, P.A.

(57) ABSTRACT

An icemaker for a refrigeration appliance includes a motor having a shaft. A feeler arm coupling is connected to a shaft of the motor. The motor is operable to rotate the feeler arm coupling about a rotation axis. A feeler arm rake is hinged to the feeler arm coupling such that the feeler arm rake is rotatable relative to the feeler arm coupling about a hinge axis. The hinge axis is perpendicular to the rotation axis. The feeler arm rake rotates with the feeler arm coupling about the rotation axis when the motor operates to rotate the feeler arm coupling.

14 Claims, 8 Drawing Sheets

ICEMAKER WITH A HINGED FEELER ARM

FIELD OF THE INVENTION

The present subject matter relates generally to icemakers and feeler arms for icemakers.

BACKGROUND OF THE INVENTION

Certain refrigerator appliances include an icemaker. The icemaker operates to generate ice for consumption. In particular, known icemakers operate to generate ice cubes, and harvested ice cubes from the icemaker are stored within a bucket. To avoid generating excessive ice cubes, a feeler arm sweeps over the ice bucket. The feeler arm impacts ice cubes on the ice bucket when the ice bucket is filled above a certain height. Thus, the feeler arm operates to determine when the ice bucket is full.

Known feeler arms have drawbacks. For example, such feeler arms sweep above a top edge of the ice bucket. Thus, such feeler arms can occupy valuable vertical space over the ice bucket, and ice cubes must fill the ice bucket over the top edge of the ice bucket for the feeler arm to impact ice cubes and detect that the ice bucket is full. Filling the bucket over the top edge of the ice bucket with ice cubes can be disadvantageous. For example, ice cubes can easily spill from the ice bucket whenever the ice bucket is moved.

BRIEF DESCRIPTION OF THE INVENTION

Aspects and advantages of the invention will be set forth in part in the following description, or may be apparent from the description, or may be learned through practice of the invention.

In a first example embodiment, an icemaker for a refrigeration appliance includes a motor having a shaft. A feeler arm coupling is connected to a shaft of the motor. The motor is operable to rotate the feeler arm coupling about a rotation axis. A feeler arm rake is hinged to the feeler arm coupling such that the feeler arm rake is rotatable relative to the feeler arm coupling about a hinge axis. The hinge axis is perpendicular to the rotation axis. The feeler arm rake rotates with the feeler arm coupling about the rotation axis when the motor operates to rotate the feeler arm coupling.

In a second example embodiment, a refrigerator appliance includes a casing that defines a chilled chamber. An icemaker is positioned within the casing or on a door of the casing. The icemaker includes a motor having a shaft. A feeler arm coupling is connected to a shaft of the motor. The motor is operable to rotate the feeler arm coupling about a rotation axis. A feeler arm rake is hinged to the feeler arm coupling such that the feeler arm rake is rotatable relative to the feeler arm coupling about a hinge axis. The hinge axis is perpendicular to the rotation axis. The feeler arm rake rotates with the feeler arm coupling about the rotation axis when the motor operates to rotate the feeler arm coupling.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
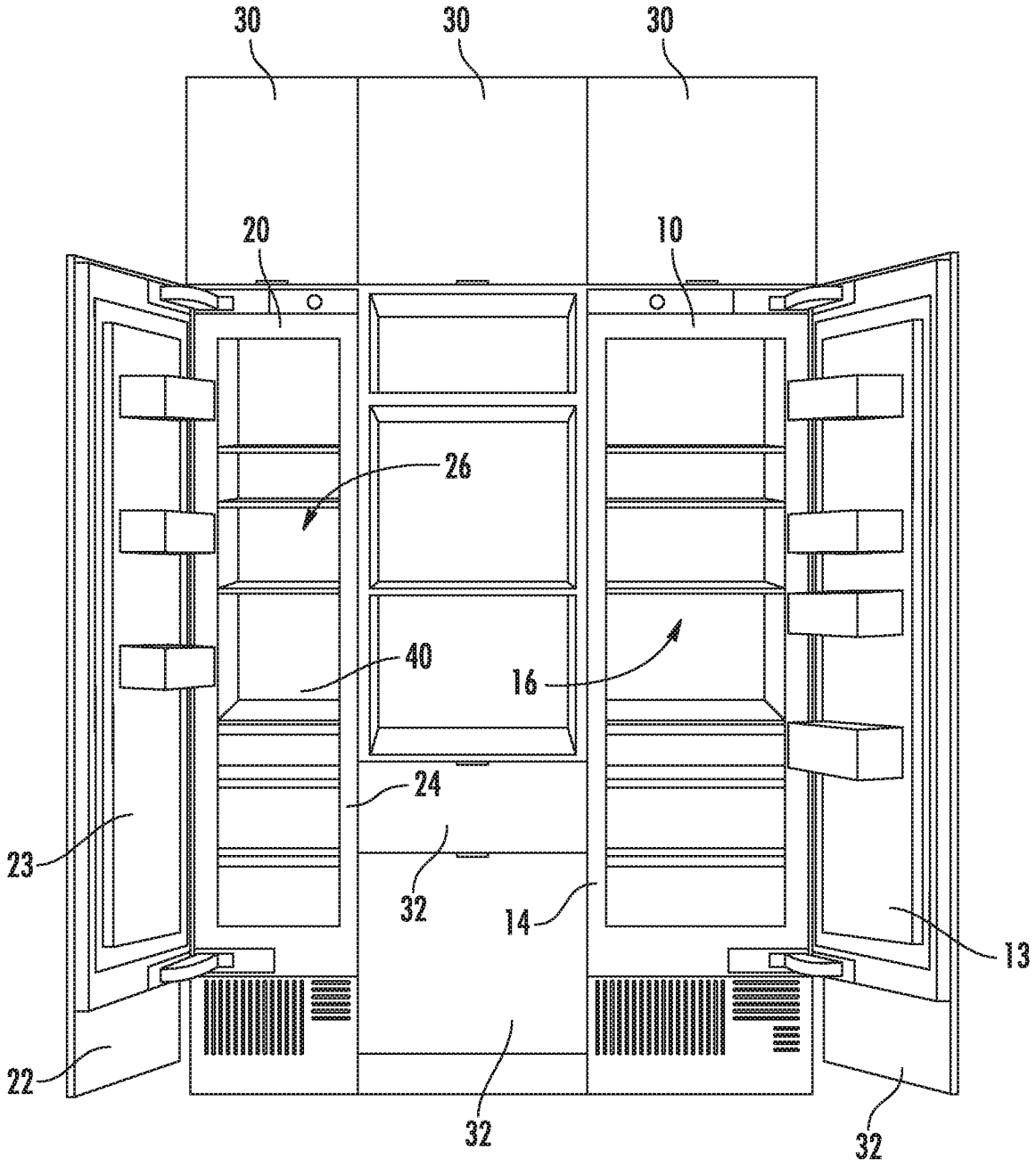
FIG. 1 is a front, elevation view of a column refrigerator appliance and column freezer appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front, elevation view of refrigeration appliances, including a column refrigerator appliance 10 and a column freezer appliance 20 according to an example embodiment of the present subject matter. As may be seen in FIG. 1, column refrigerator appliance 10 and/or column freezer appliance 20 may be positioned within a set of cabinets 30. A front panel 12 on a door 13 of column refrigerator appliance 10 and/or a front panel 22 on a door 23 of column freezer appliance 20 may match the front panels 32 of cabinets 30. Thus, column refrigerator appliance 10 and column freezer appliance 20 may match an appearance of cabinets 30. It will be understood that column refrigerator appliance 10 and column freezer appliance 20 are provided by way of example only. Other configurations for refrigeration appliances are within the scope of the present subject matter. For example, the present subject matter may be used in and/or with appliances with both freezer and chilled compartments, only freezer compartments, only chilled compartments, or other combinations thereof different from that shown in FIG. 1.

As may be seen in FIG. 1, column refrigerator appliance 10 is depicted as an upright refrigerator having a casing 14 that defines an internal chilled fresh food chamber 16, and column freezer appliance 20 is depicted as an upright freezer having a casing 24 that defines an internal chilled freezer chamber 26. Each of column refrigerator appliance 10 and column freezer appliance 20 also includes a respective heat pump system (not shown) for the removal of heat from internal chilled fresh food chamber 14 and internal chilled freezer chamber 24. As will be understood by those skilled in the art, the heat pump systems may each include a compressor, a condenser, an expansion device, and an evaporator connected in series and charged with a refrigerant.

An icemaker 40 is positioned within freezer chamber 26. Icemaker 40 is operable to generate ice for consumption. It will be understood that icemaker 40 may be positioned within column refrigerator appliance 10 in alternative example embodiments. Further, it will be understood that icemaker 40 may be mounted on door 23 in alternative example embodiments.

Figure 2:
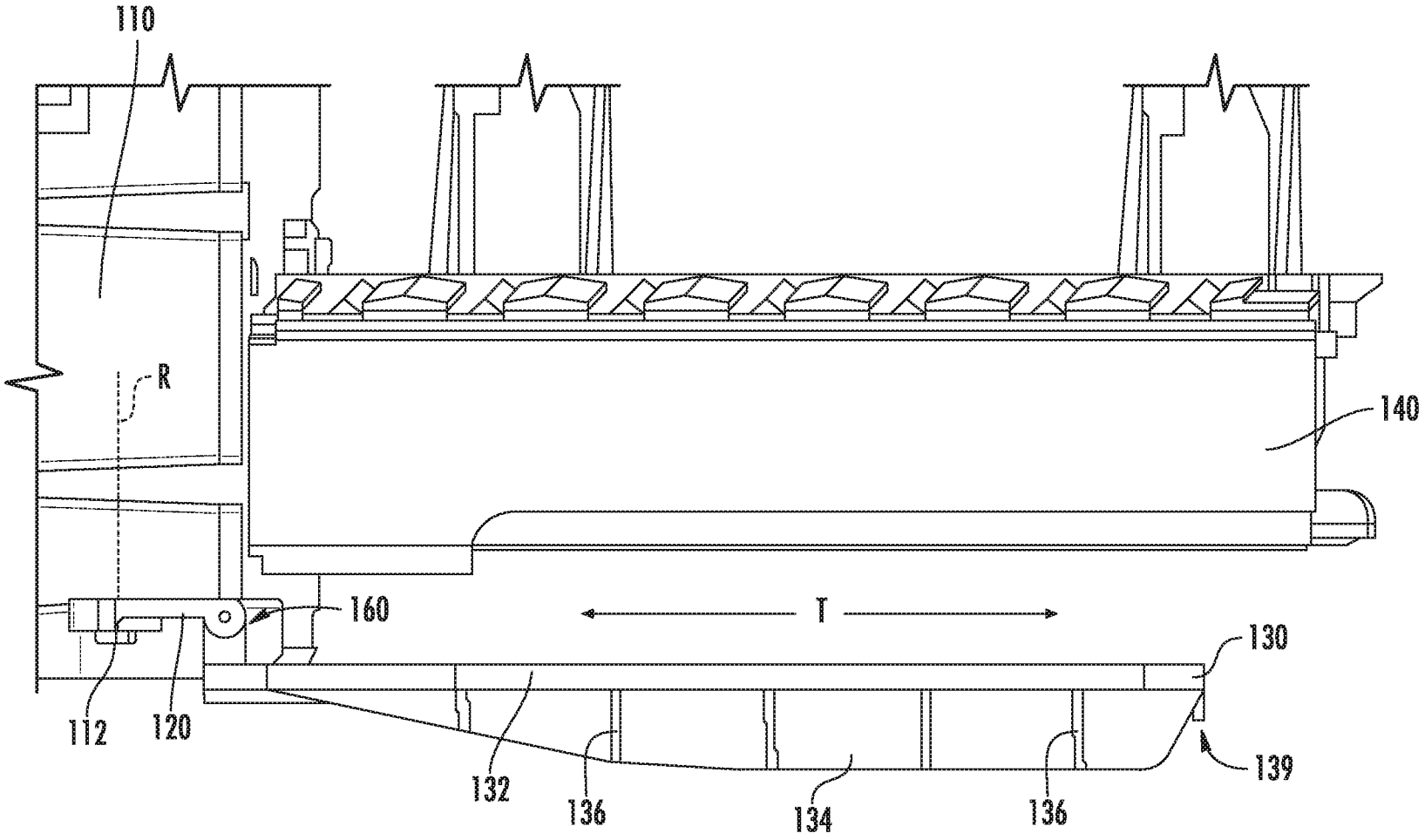
FIGS. 2 and 3 are side, elevation views of an icemaker according to an example embodiment of the present subject matter.
Figure 3:
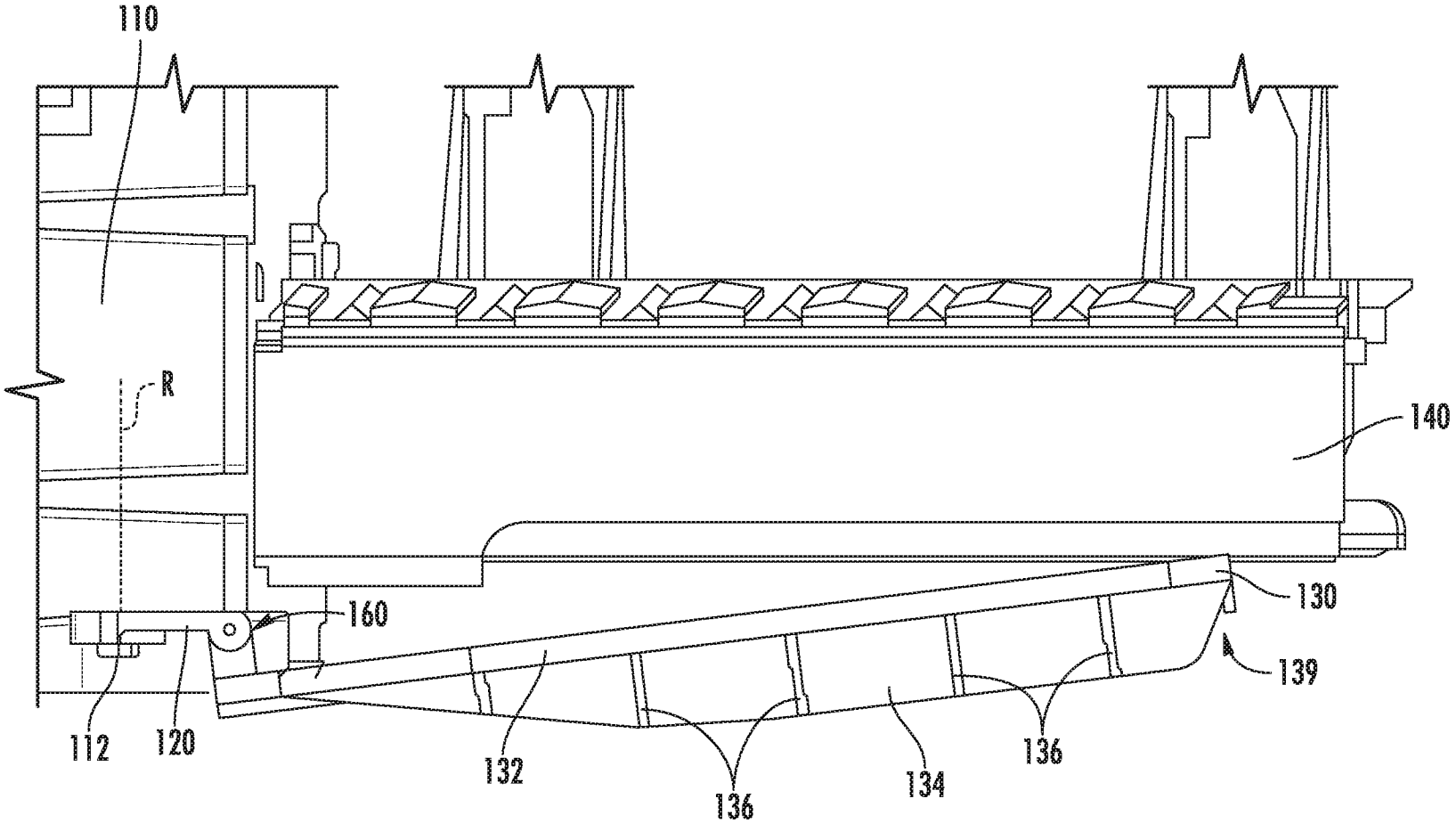

FIGS. 2 and 3 are side, elevation views of an icemaker 100 according to an example embodiment of the present subject matter. Icemaker 100 may be used in or with column refrigerator appliance 10 and/or column freezer appliance 20 as icemaker 40. Thus, icemaker 100 may be positioned in casing 14 of column refrigerator appliance 10 or in casing 24 of column freezer appliance 20. Icemaker 100 is described in greater detail below in the context of column freezer appliance 20. However, it will be understood that icemaker 100 may also be utilized in or within any other suitable refrigeration appliance.

Icemaker 100 includes a motor 110 with a shaft 112. Motor 110 is operable to rotate shaft 112. For example, motor 110 may be operable to rotate shaft 112 in a first rotational direction by a suitable fraction of one or more radians and in a second rotational direction by the same fraction of one or more radians. In addition, motor 110 may be operable to sequentially rotate shaft 112 in the first and second rotational directions.

Icemaker 100 also includes a feeler arm coupling 120 and a feeler arm rake 130. Feeler arm coupling 120 and feeler arm rake 130 collectively form a feeler arm of icemaker 100. Feeler arm coupling 120 is connected to shaft 112 of motor 110. Motor 110 is operable to rotate feeler arm coupling 120 about a rotation axis R. In particular, motor 110 may be operable to rotate feeler arm coupling 120 about the rotation axis R in the same or similar manner to that described above for shaft 112. Feeler arm coupling 120 may be connected to shaft 112 by inserting shaft 112 into feeler arm coupling 120. For example, feeler arm coupling 120 may define a lug interface 122 (FIG. 5), and shaft 112 of motor 110 may be received within lug interface 122. Lug interface 122 may be shaped such that interference between shaft 112 of motor 110 and feeler arm coupling 120 at lug interface 122 may rotationally fix shaft 112 to feeler arm coupling 120.

Feeler arm rake 130 is hinged to feeler arm coupling 120. In particular, feeler arm rake 130 is hinged to feeler arm coupling 120 such that feeler arm rake 130 is rotatable relative to feeler arm coupling 120 about a hinge axis H (shown in FIG. 4 and extending into and out of the page in the perspective of FIGS. 2 and 3). The hinge axis H is perpendicular to the rotation axis R. It will be understood that the hinge axis H need not be oriented at exactly ninety degrees (90°) to the rotation axis R in certain example embodiments. Rather, the term "perpendicular" as used herein includes a ten degree margin (i.e., 90°±10°). Thus, the hinge axis H may be oriented generally perpendicular to the rotation axis R. Feeler arm rake 130 may also be connected to feeler arm coupling 120 such that feeler arm rake 130 rotates with feeler arm coupling 120 about the rotation axis R when motor 110 operates to rotate feeler arm coupling 120.

Feeler arm rake 130 may be rotatable on the hinge axis H between a resting position (shown in FIG. 2) and a lifted position (shown in FIG. 3). As discussed in greater detail below, shifting feeler arm rake 130 between from the resting position to the lifted position may allow an ice bucket 150 (FIGS. 6 through 8) to move relative to feeler arm rake 130 without feeler arm rake 130 blocking such movement. Thus, the hinged connection between feeler arm coupling 120 and feeler arm rake 130 may advantageously facilitate movement of feeler arm rake 130 relative to ice bucket 150.

Icemaker 100 also includes a mold body 140. Mold body 140 is configured for receiving a flow of liquid water. Within mold body 140, the liquid water may freeze to form ice cubes within mold body 140. The ice cubes may be harvested from mold body 140 and directed into ice bucket 150. Feeler arm rake 130 may be positioned below mold body 140. When motor 110 rotates feeler arm rake 130, feeler arm rake 130 may sweep through ice bucket 150. As feeler arm rake 130 sweeps through ice bucket 150, feeler arm rake 130 may impact against ice cubes within ice bucket 150 when ice bucket 150 is suitably filled within ice cubes. In such a manner, feeler arm rake 130 may be used to detect when ice bucket 150 is suitably filled within ice cubes.

Figure 4:
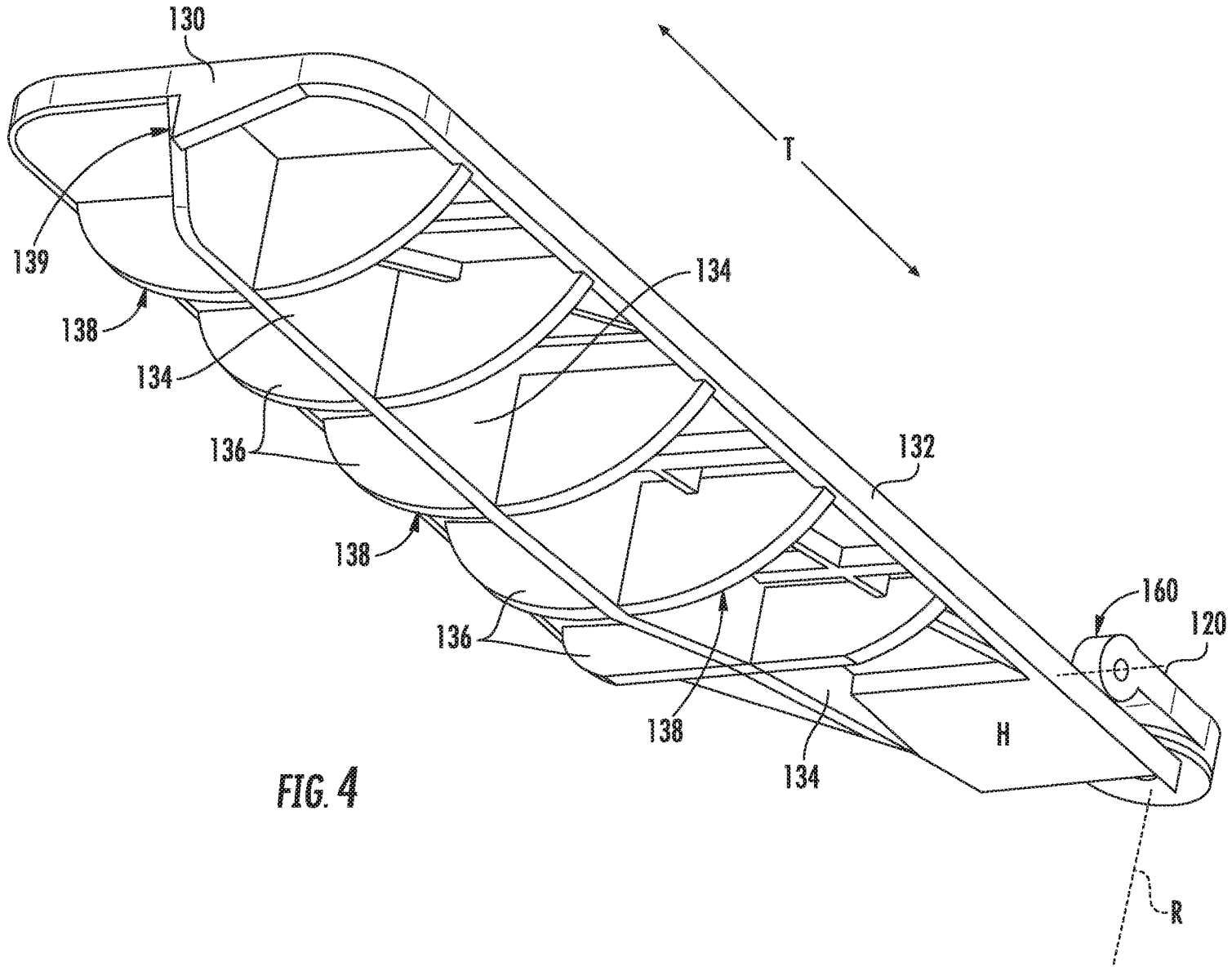
FIG. 4 is a bottom, perspective view of a feeler arm of the example icemaker of FIG. 2.

FIG. 4 is a bottom, perspective view of the feeler arm of icemaker 100. As may be seen in FIG. 4, feeler arm rake 130 includes an elongated plate 132 and a sweep plate 134. Elongated plate 132 extends radially away (e.g., relative to the rotation axis R) from feeler arm coupling 120 along a length of elongated plate 132. Sweep plate 134 is mounted to elongated plate 132 and extends downwardly from elongated plate 132. Sweep plate 134 may also extend radially away (e.g., relative to the rotation axis R) from feeler arm coupling 120 along a length of sweep plate 134. Sweep plate 134 may impact against ice cubes within ice bucket 150 when feeler arm rake 130 sweeps through ice bucket 150, in the manner described above.

Feeler arm rake 130 may also include a plurality of lift plates 136. Lift plates 136 extend downwardly from elongated plate 132. Lift plates 136 may also be distributed along a transverse direction T, e.g., that is perpendicular to the rotation axis R and the hinge axis H. Lift plates 136 may be shaped to ride up ice bucket 150 as feeler arm rake 130 shifts from the resting position to the lifted position. As an example, each lift plate 136 may have an arcuate bottom surface 138. Arcuate bottom surface 138 may impact and slide up ice bucket 150 as feeler arm rake 130 shifts from the resting position to the lifted position. As another example, each lift plate 136 may have a suitably sloped bottom surface 138. Lift plates 136 may also be oriented perpendicular to sweep plate 134 on elongated plate 132, as shown in FIG. 4.

Figure 5:
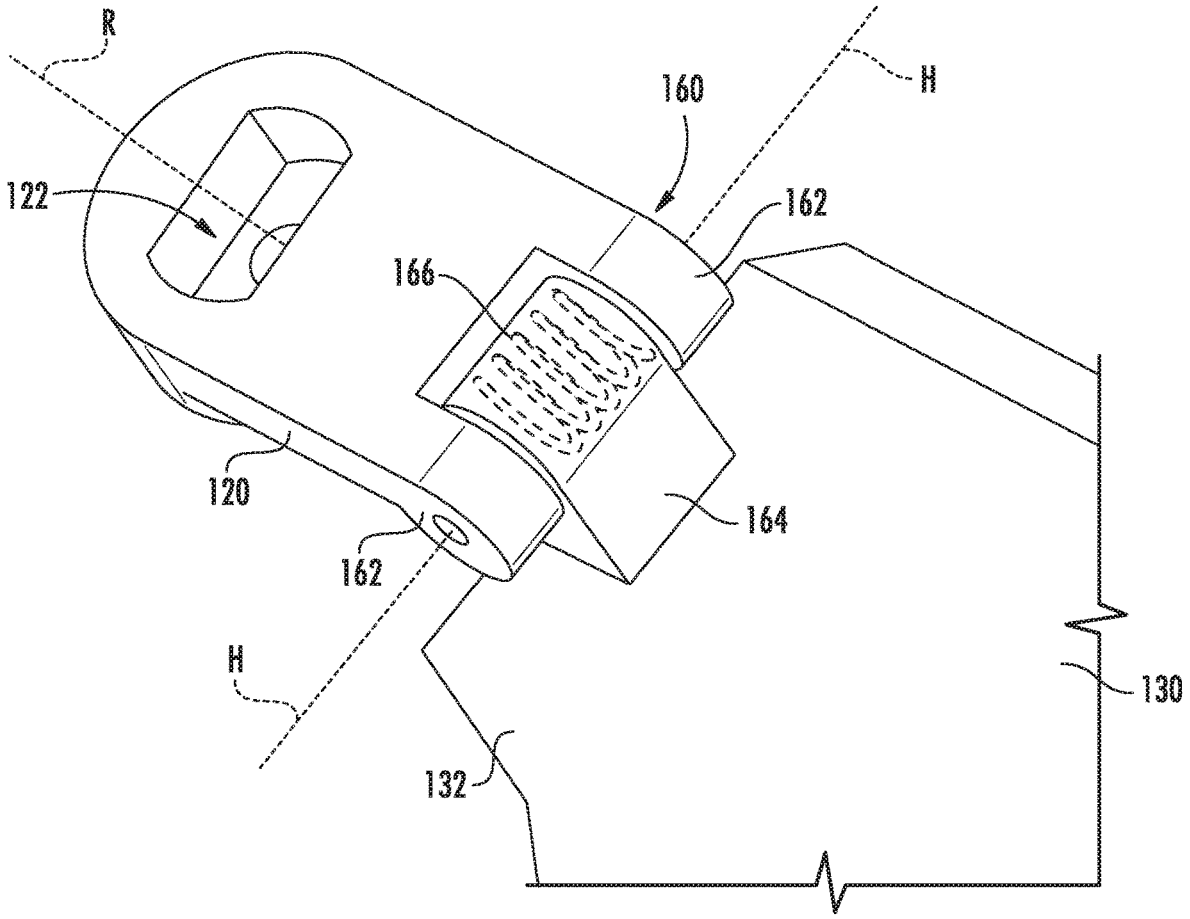
FIG. 5 is a partial perspective view of a hinge of the feeler arm of FIG. 4.

FIG. 5 is a partial perspective view of a hinge 160 of the feeler arm. Hinge 160 may connect feeler arm rake 130 to feeler arm coupling 120 such that feeler arm rake 130 is rotatable relative to feeler arm coupling 120 about the hinge axis H. Hinge 160 includes a pair of hinge arms 162 and a hinge post 164. Hinge arms 162 are mounted to one of feeler arm rake 130 and feeler arm coupling 120. In FIG. 5, hinge arms 162 are shown mounted to feeler arm coupling 120. Hinge post 164 is positioned between hinge arms 162. In addition, hinge post 164 is mounted to the other of feeler arm rake 130 and feeler arm coupling 120. In FIG. 5, hinge post 164 is mounted to feeler arm rake 130. An axle (not shown) may extend through hinge arms 162 and hinge post 164 to rotatably couple hinge post 164 to hinge arms 162.

Hinge 160 also includes a spring 166. Spring 166 urges feeler arm rake 130 towards the resting position. Thus, spring 166 may be coupled to feeler arm rake 130 such that feeler arm rake 130 is normally in the resting position. In FIG. 5, spring 166 is a helical spring. In alternative example embodiments, spring 166 may be a tension spring or a compression spring. A distal end portion 139 (FIG. 4) of feeler arm rake 130 may also be weighted to assist with urging feeler arm rake 130 towards the resting position. It will be understood that distal end portion 139 of feeler arm rake 130 may move vertically when feeler arm rake 130 rotates on the hinge axis H.

Figure 6:
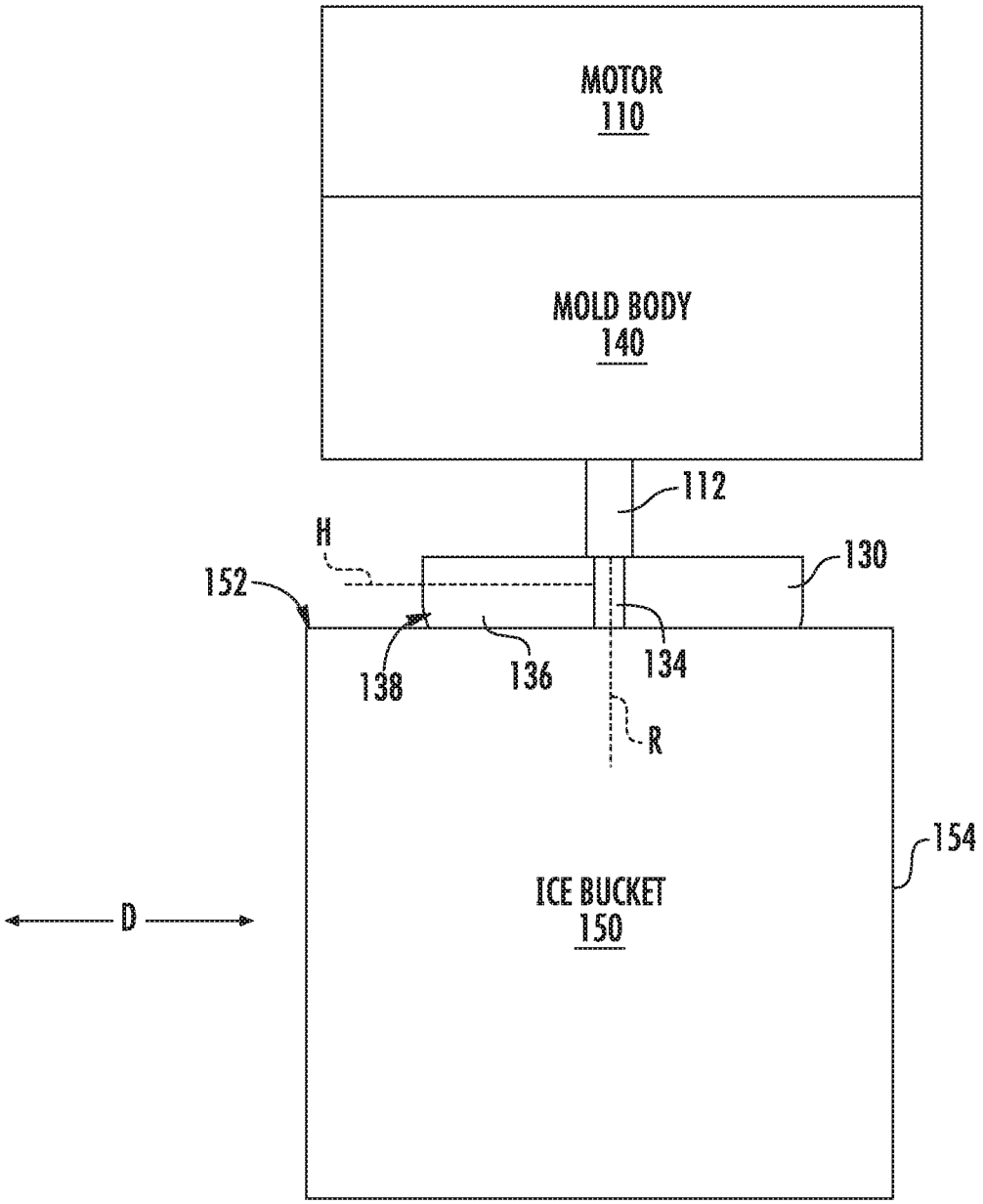
FIGS. 6 through 8 are schematic views of the example icemaker of FIG. 2 with an ice bucket shown in various positions relative to the feeler arm of the example icemaker.
Figure 7:
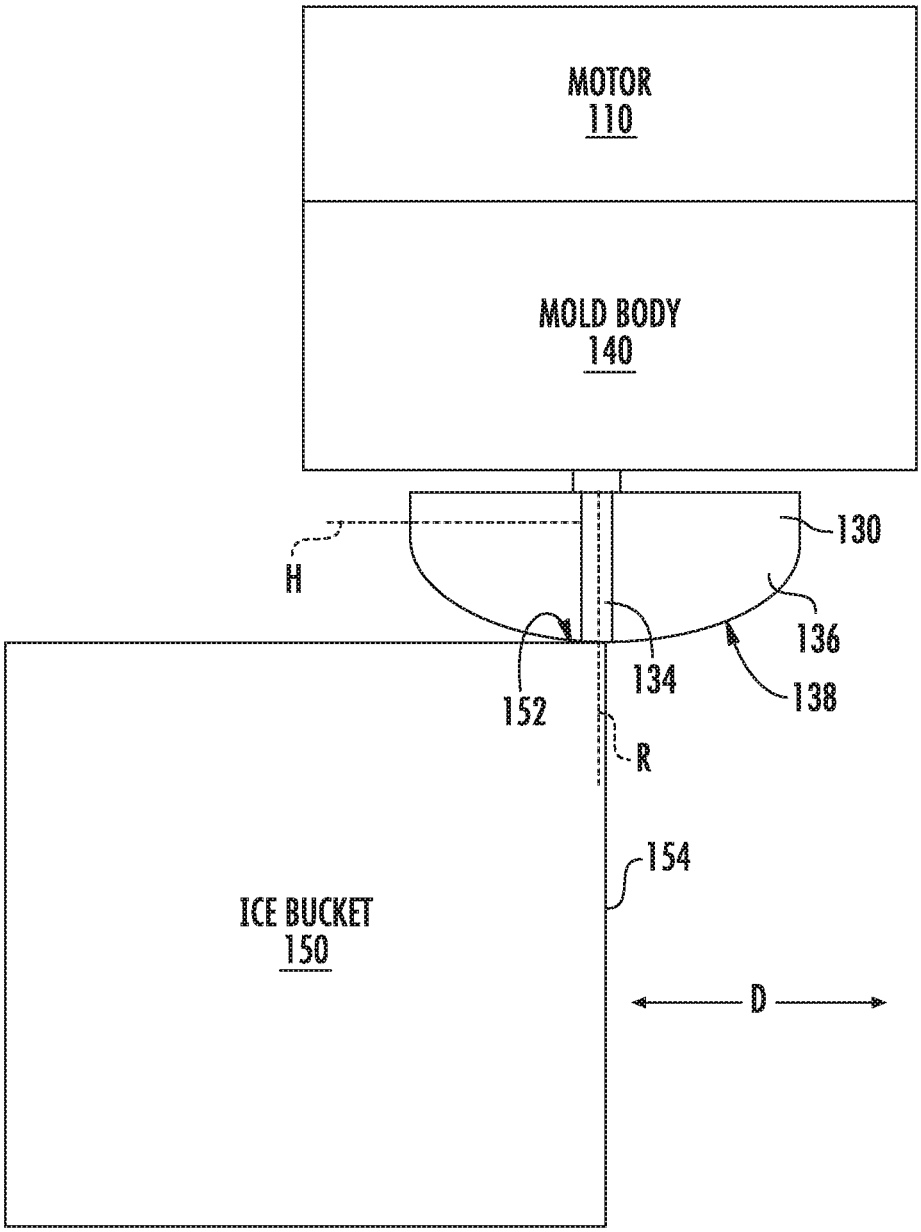
Figure 8:
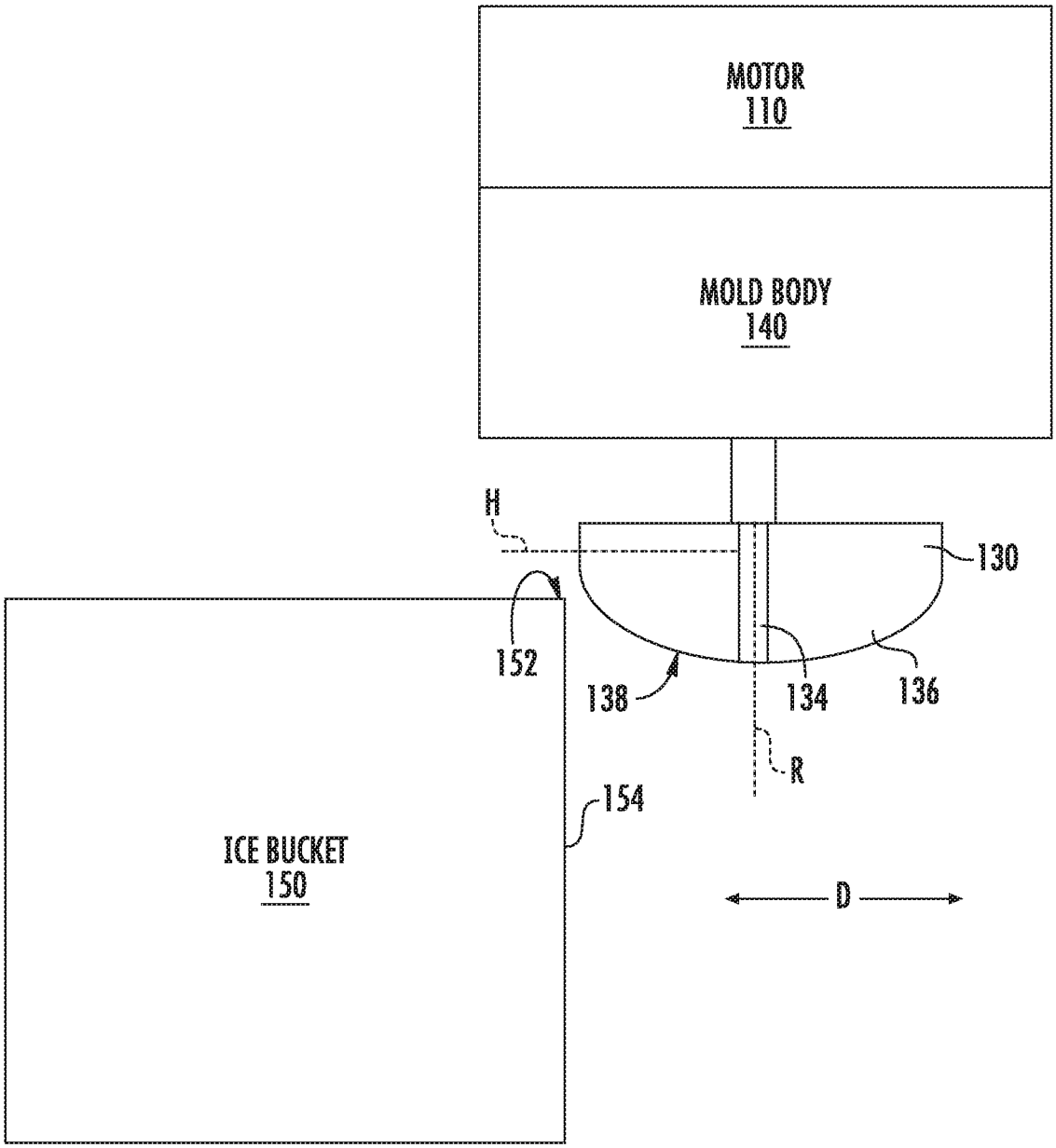

FIGS. 6 through 8 are schematic views of icemaker 100 with ice bucket 150 shown in various positions relative to the feeler arm of icemaker 100. As shown in FIGS. 6 through 8, feeler arm rake 130 shifts from the resting position to the lifted position when ice bucket 150 moves below feeler arm rake 130. Starting from FIG. 6, feeler arm rake 130 is in the resting position, and ice bucket 150 is positioned below feeler arm rake 130. In addition, sweep plate 134 and/or lift plates 136 may be positioned within ice bucket 150. In the configuration shown in FIG. 6, feeler arm rake 130 may be used to detect when ice bucket 150 is suitably filled within ice cubes by sweeping through ice bucket 150 in the manner described above. In particular, motor 110 may operate to rotate feeler arm rake 130 about the rotation axis R in order to sweep feeler arm rake 130 through ice bucket 150.

From the arrangement of FIG. 6, a user of column refrigerator appliance 10 may desire to move ice bucket 150. Thus, the user may grasp ice bucket 150 and pull ice bucket 150 in a direction away from feeler arm rake 130. In particular, ice bucket 150 may be removable from below mold body 140 by the user pulling ice bucket along a removal direction D, e.g., that is perpendicular to the rotation axis R and/or parallel to the hinge axis H. As used herein, the term "parallel" includes a ten degree margin (i.e., 0°±10°).

During movement of ice bucket 150 along the removal direction D from the position shown in FIG. 6, feeler arm rake 130 impacts a sidewall 154 of ice bucket 150. Due to the shape of feeler arm rake 130 (e.g., lift plates 136), feeler arm rake 130 may slide up sidewall 154 of ice bucket 150 and rotate on the hinge axis H from the resting position to the lifted position as shown in FIG. 7. Thus, e.g., feeler arm rake 130 may be positioned in the lifted position when sidewall 154 of ice bucket 150 is positioned directly below feeler arm rake 130. From FIG. 7, the user may continue to pull ice bucket 150 in the removal direction D until ice bucket 150 is completely removed from under feeler arm rake 130 as shown in FIG. 8. When ice bucket 150 is removed from under feeler arm rake 130, feeler arm rake 130 may shift back to the resting position.

It will be understood that the process described above for removing ice bucket 150 from beneath feeler arm rake 130 may be reversed to insert ice bucket 150 below feeler arm rake 130. In such a manner, ice bucket 150 may be advantageously removed and inserted below feeler arm rake 130 without feeler arm rake 130 snagging against ice bucket 150. In particular, hinging feeler arm rake 130 to feeler arm coupling 120 such that feeler arm rake 130 may be rotatable on the hinge axis H may advantageously allow sweep plate 134 and/or lift plates 136 to extend into ice bucket 150 below a top edge 152 of ice bucket 150 while still allowing ice bucket 150 to freely move along the removal direction D relative to feeler arm rake 130. Thus, feeler arm rake 130 may impact against ice cubes below the top edge 152 of ice bucket 150, and filling of ice bucket 150 with ice cubes above the top edge 152 of ice bucket 150 may be avoided or prevented. By avoiding overfilling ice bucket 150, ice bucket 150 may be removed from below mold body 140 with reduced or no spillage of ice cubes from ice bucket 150.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker for a refrigeration appliance, comprising:
a motor having a shaft;
a feeler arm coupling connected to the shaft of the motor, the motor operable to rotate the feeler arm coupling about a rotation axis; and
a feeler arm rake hinged to the feeler arm coupling such that the feeler arm rake is rotatable relative to the feeler arm coupling about a hinge axis, the hinge axis being perpendicular to the rotation axis,
wherein the feeler arm rake rotates with the feeler arm coupling about the rotation axis when the motor operates to rotate the feeler arm coupling,
wherein the feeler arm rake comprises an elongated plate, a sweep plate, and a plurality of lift plates, the sweep plate extending downwardly from the elongated plate, the plurality of lift plates extending downwardly from the elongated plate, the plurality of lift plates distributed along a transverse direction that is perpendicular to the rotation axis and the hinge axis, and
wherein each lift plate of the plurality of lift plates has an arcuate bottom surface.

2. The icemaker of claim 1, further comprising a mold body, the feeler arm rake is positioned below the mold body.

3. The icemaker of claim 1, wherein the feeler arm rake is rotatable on the hinge axis between a resting position and a lifted position.

4. The icemaker of claim 3, further comprising a hinge connecting the feeler arm rake to the feeler arm coupling, the hinge comprising a pair of hinge arms and a hinge post, the pair of hinge arms mounted to one of the feeler arm rake and the feeler arm coupling, the hinge post positioned between the pair of hinge arms and mounted to the other of the feeler arm rake and the feeler arm coupling.

5. The icemaker of claim 4, wherein the hinge further comprises a spring urging the feeler arm rake towards the resting position.

6. The icemaker of claim 1, wherein the feeler arm coupling defines a lug interface, the shaft of the motor received within the lug interface.

7. The icemaker of claim 1, further comprising a bucket, the bucket moveable relative to the feeler arm rake, the feeler arm rake is rotates on the hinge axis from a resting position to a lifted position when a lip of the bucket is positioned below of the feeler arm rake.

8. A refrigerator appliance, comprising:
a casing defining a chilled chamber;
an icemaker positioned within the casing or on a door of the casing, the icemaker comprising
a motor having a shaft;
a feeler arm coupling connected to the shaft of the motor, the motor operable to rotate the feeler arm coupling about a rotation axis; and
a feeler arm rake hinged to the feeler arm coupling such that the feeler arm rake is rotatable relative to the feeler arm coupling about a hinge axis, the hinge axis being perpendicular to the rotation axis,
wherein the feeler arm rake rotates with the feeler arm coupling about the rotation axis when the motor operates to rotate the feeler arm coupling,
wherein the feeler arm rake comprises an elongated plate, a sweep plate, and a plurality of lift plates, the sweep plate extending downwardly from the elongated plate, the plurality of lift plates extending downwardly from the elongated plate, the plurality of lift plates distributed along a transverse direction that is perpendicular to the rotation axis and the hinge axis, and wherein each lift plate of the plurality of lift plates has an arcuate bottom surface.

9. The refrigerator appliance of claim 8, wherein the icemaker further comprises a mold body, the feeler arm rake is positioned below the mold body.

10. The refrigerator appliance of claim 8, wherein the feeler arm rake is rotatable on the hinge axis between a resting position and a lifted position.

11. The refrigerator appliance of claim 10, wherein the icemaker further comprises a hinge connecting the feeler arm rake to the feeler arm coupling, the hinge comprising a pair of hinge arms and a hinge post, the pair of hinge arms mounted to one of the feeler arm rake and the feeler arm coupling, the hinge post positioned between the pair of hinge arms and mounted to the other of the feeler arm rake and the feeler arm coupling.

12. The refrigerator appliance of claim 11, wherein the hinge further comprises a spring urging the feeler arm rake towards the resting position.

13. The refrigerator appliance of claim 8, wherein the feeler arm coupling defines a lug interface, the shaft of the motor received within the lug interface.

14. The refrigerator appliance of claim 8, wherein the icemaker further comprises a bucket, the bucket moveable relative to the feeler arm rake, the feeler arm rake is rotates on the hinge axis from a resting position to a lifted position when a lip of the bucket is positioned below of the feeler arm rake.

* * * * *